US011213836B2

(12) United States Patent
Duffin et al.

(10) Patent No.: US 11,213,836 B2
(45) Date of Patent: Jan. 4, 2022

(54) NUTATING SPRINKLER HEAD

(71) Applicants: Don D. Duffin, Paul, ID (US); Roger M. Duffin, Paul, ID (US)

(72) Inventors: Don D. Duffin, Paul, ID (US); Roger M. Duffin, Paul, ID (US)

( * ) Notice: Subject to any disclaimer, the term of this patent is extended or adjusted under 35 U.S.C. 154(b) by 195 days.

(21) Appl. No.: 16/701,036

(22) Filed: Dec. 2, 2019

(65) Prior Publication Data

US 2020/0215556 A1 Jul. 9, 2020

Related U.S. Application Data

(60) Provisional application No. 62/773,971, filed on Nov. 30, 2018.

(51) Int. Cl.
*B05B 3/00* (2006.01)
*B05B 3/04* (2006.01)

(52) U.S. Cl.
CPC ..... *B05B 3/008* (2013.01); *B05B 3/0422* (2013.01)

(58) Field of Classification Search
CPC ... B05B 3/0422; B05B 3/0486; B05B 3/0445; B05B 3/0463; B05B 3/0427; B05B 3/008
USPC ..... 239/222.21
See application file for complete search history.

(56) References Cited

U.S. PATENT DOCUMENTS 3,312,400 A 4/1967 Clearman
4,773,594 A 9/1988 Clearman
4,795,100 A 1/1989 Purtell et al.
4,949,905 A 4/1990 Jones et al.
5,333,796 A 8/1994 Purtell et al.
5,381,960 A 1/1995 Sullivan et al.
5,950,927 A 9/1999 Elliott et al.
6,176,440 B1 1/2001 Elliott
6,439,477 B1 * 8/2002 Sweet ..... B05B 3/008 239/214
6,932,279 B2 8/2005 Burcham
7,070,122 B2 7/2006 Burcham et al.
7,287,710 B1 10/2007 Nelson et al.
7,562,833 B2 7/2009 Perkins et al.
7,770,821 B2 8/2010 Pinch
7,942,345 B2 5/2011 Sesser et al.
8,028,932 B2 10/2011 Sesser et al.
(Continued)

*Primary Examiner* — Steven M Cernoch
(74) *Attorney, Agent, or Firm* — Shaver & Swanson, LLP; Scott D. Swanson

(57) ABSTRACT

A sprinkler head for irrigation having a sprinkler body. The sprinkler body surrounds a fluid delivery tube. The sprinkler body includes an upper plate and a lower plate. A and exits out the fluid nozzle. A fluid distribution cage is positioned on the sprinkler body and around the fluid delivery tube. The fluid distribution cage has one or more arms connecting an upper plate and a lower plate. The lower plate is configured to direct fluid sprayed onto it from the fluid delivery tube. When fluid is sprayed on the lower plate the upper plate begins to nutate around the fluid delivery tube between the upper sprinkler body plate and lower sprinkler body plate. The upper and lower sprinkler body plates have races configured for receiving one or more resilient cushions positioned on the upper plate of the fluid distribution cage. The upper cage plate or the lower sprinkler body plate has one or more projections positioned such that the fluid distribution cage hangs at an angle to facilitate initiation of nutation of the fluid distribution cage.

5 Claims, 16 Drawing Sheets

(56) References Cited

U.S. PATENT DOCUMENTS

| | | | | |
|---|---|---|---|---|
| 8,991,724 | B2 | 3/2015 | Sesser et al. | |
| 9,457,363 | B2 * | 10/2016 | Duffin | B05B 3/008 |
| 10,239,066 | B2 | 3/2019 | Sesser et al. | |
| 2019/0054480 | A1 | 2/2019 | Sesser et al. | |

* cited by examiner

NUTATING SPRINKLER HEAD

PRIORITY/CROSS-REFERENCE TO RELATED APPLICATIONS

This application claims the benefit of U.S. Provisional Application No. 62/773,971 filed Dec. 2, 2019, the disclosure of which is incorporated by reference.

TECHNICAL FIELD

The herein disclosed and claimed inventive concepts generally relate to a sprinkler head, and more particularly to a nutating sprinkler head for randomizing fluid distribution.

BACKGROUND

Irrigation systems such as center pivot systems have a structure from which down tube are suspended, with sprinkler heads attached to the down tubes. The sprinkler heads take a number of different forms and all try to create a uniform and random spread of fluid droplets, or a size which does not result in excessive evaporation. The sprinkling heads may also be mounted on top of the rotating structures of the center pivot systems, or on upward turned ends of the down tubes. Such sprinkler heads can operate in any orientation, because the force of the fluid stream is greater than the force of gravity on the lightweight sprinkler parts. However, for convenience the sprinkler head and its parts are described as being in the orientation as shown in the figures, with "upper", "lower", "tops", and "bottom" surfaces applied to the sprinkler parts in the orientation shown in the figures.

SUMMARY OF THE DISCLOSURE

What is disclosed is a improved fluid distributing sprinkler head. The fluid distributing sprinkler head is made up of a sprinkler body which partially encloses a fluid delivery tube with an attached fluid nozzle. Fluid flows through the sprinkler body and exits out the fluid nozzle. The fluid nozzle constricts the fluid stream to form the fluid stream into a narrower stream of fluid.

The sprinkler body includes a sprinkler body upper plate, and a sprinkler lower plate. Each of these are generally ring shaped, and have a passage for the stream of fluid or the fluid delivery tube to pass through. Each of the sprinkler body plates has a first side and a second side, which correspond to an upper side, and a lower side, as the sprinkler head is shown in the figures. In an embodiment the sprinkler body upper and lower plates are fixedly attached to the fluid delivery tube. In another embodiment the fluid delivery tube is threaded at both ends for attachment to the sprinkler body, preferably to the sprinkler body upper plate and to the sprinkler body lower plate. Threaded attachment allows for interchangeability of the fluid distribution cage, discussed below, as well as for repair of the sprinkler head in the event that one or more pieces breaks or malfunctions.

The fluid distribution cage is made up of a lower cage plate with a first and second side, and an upper cage plate with a first and second side. The upper and lower cage plates can also be called the swash plate, and the strike plate. The two cage plates are coplanar and held in a spaced apart relationship by one or more cage arms. The upper cage plate is positioned between the sprinkler body upper and lower plates, and there is sufficient room between the sprinkler body upper and lower plates for the upper cage plate to rock back and forth (also called to nutate), as well as to rotate around the stationary sprinkler body plates. The upper portion can be a circular ring shape, trilobal, or any other shape that will function to nutate between the sprinkler body upper plate and lower plate. The term "plate" used in conjunction with the upper sprinkler body plate and lower sprinkler body plate denotes that the lower side of the upper sprinkler plate and the upper side of the lower sprinkler plate are generally formed to allow for the nutating of the upper cage plate between the two surfaces. The upper side of the upper sprinkler body plate and the lower side of the lower sprinkler body plate can be in a variety of shapes that allow for the function of the sprinkler.

The upper cage plate defines a passage for the fluid delivery tube lower end, and also has one or more raised projections adjacent to the fluid passage. If there are one or more projections, the projections are preferably positioned opposite each other on a second (bottom) side of the upper cage plate (swash plate), and rest on the first (upper) surface of the sprinkler body lower plate. The projections serve to destabilize the fluid distributing cage, and to initiate a motion of the fluid distributing cage to rotate and tilt simultaneously, in a manner similar to a coin which is placed on its side and spun. The motion is called nutation, and at the end of the coin's spinning, it is rotating slowly, while rocking side to side, or nutating.

The fluid distribution cage has a generally circular lower cage plate first (top) side which has a generally peaked or pointed surface profile, preferably with an upturned edge at the periphery of the plate. This plate can be called the strike plate. The surface is incised by spirally radiating grooves which radiate from a central raised point in the center. The raised point in the center of the plate has a beveled top surface. This is so that when it is first struck by a stream of fluid, and fluid will deflect the plate to one side, a motion caused by the bevel. Once the strike plate is deflected to one side by the initial impact of fluid, the fluid stream then strikes the radiating groove on the strike plate, which initiates the spiral motion. The projections on the upper cage plate facilitate this initiation of motion, by keeping the cage from stabilizing when struck by the fluid stream. Alternatively the projections can be positioned on the lower sprinkler body plate.

The fluid distribution cage thus hangs freely from one or more raised projections when fluid is not flowing through the sprinkler head and the sprinkler head is in a vertical position, with the bevel on the lower plate provided for deflecting the strike plate by an initial jet of fluid from the fluid directing tube. These structures plus the spirally radiating grooves serve to initiate a nutating motion in said fluid distribution cage after the initial deflection by the force of fluid.

Another feature of the sprinkler head are one or more resilient cushions on the swash plate. These can be rubber or rubber like material affixed or attached to the surfaces of the sprinkler body upper plate second (lower) edge and the sprinkler body lower plate first (top) plate. The resilient cushions are placed on the swash plate to interact with races located on the upper and lower cage upper plate. The cushions serve to increase the friction between sprinkler body plates and the cage upper plate, to the cage upper plate nutates rather than spin on the sprinkler body. They also provide a dampening effect and reduction of wear between said sprinkler body plates and the upper cage plate surfaces.

The sprinkler head can have as an option a weight, with the purpose of the weight being to dampen the vibrations caused nutation and help prevent wind from blowing the sprinklers away from vertical when they are hung over the crop on rubber hose.

In a preferred embodiment the fluid delivery tube includes a notch or groove that provides relief and allows additional space for the upper cage plate to begin nutation. The notch is an indentation into the circumference of the tube. The notch preferably has a width of about 4.5 inches and a depth of 0.625 inches, although variations can be utilized and still fall within the scope of the invention.

DETAILED DESCRIPTION OF THE EXEMPLARY EMBODIMENTS

Figure 1:
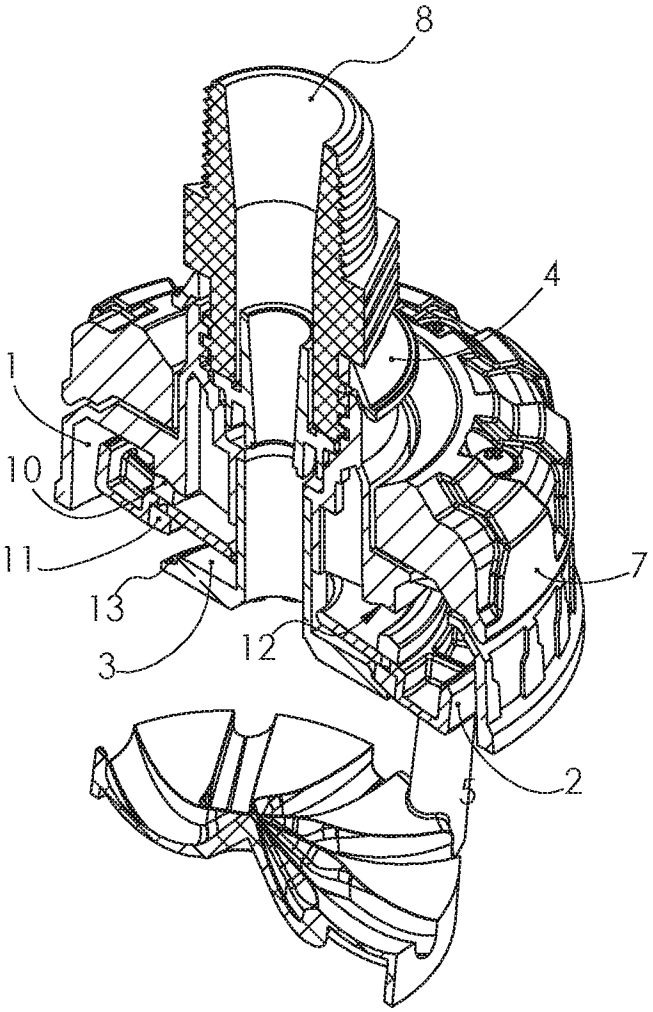
FIG. 1 is a perspective cross sectional view of a first embodiment of a sprinkler head.

While the presently disclosed inventive concept(s) is susceptible of various modifications and alternative constructions, certain illustrated embodiments thereof have been shown in the drawings and will be described below in detail. It should be understood, however, that there is no intention to limit the inventive concept(s) to the specific form disclosed, but, on the contrary, the presently disclosed and claimed inventive concept(s) is to cover all modifications, alternative constructions, and equivalents falling within the spirit and scope of the inventive concept(s) as defined in the claims.

Figure 2:
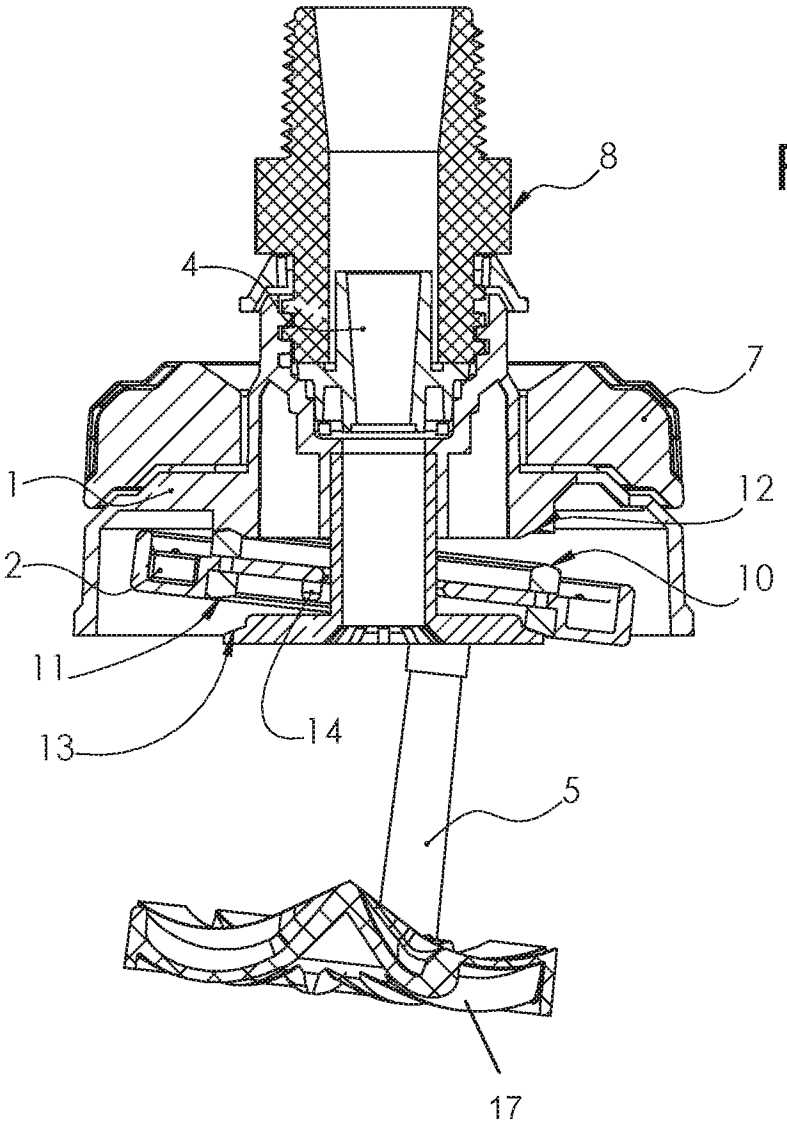
FIG. 2 is a cross sectional view of a first embodiment of a sprinkler head through the center of the sprinkler head.
Figure 3:
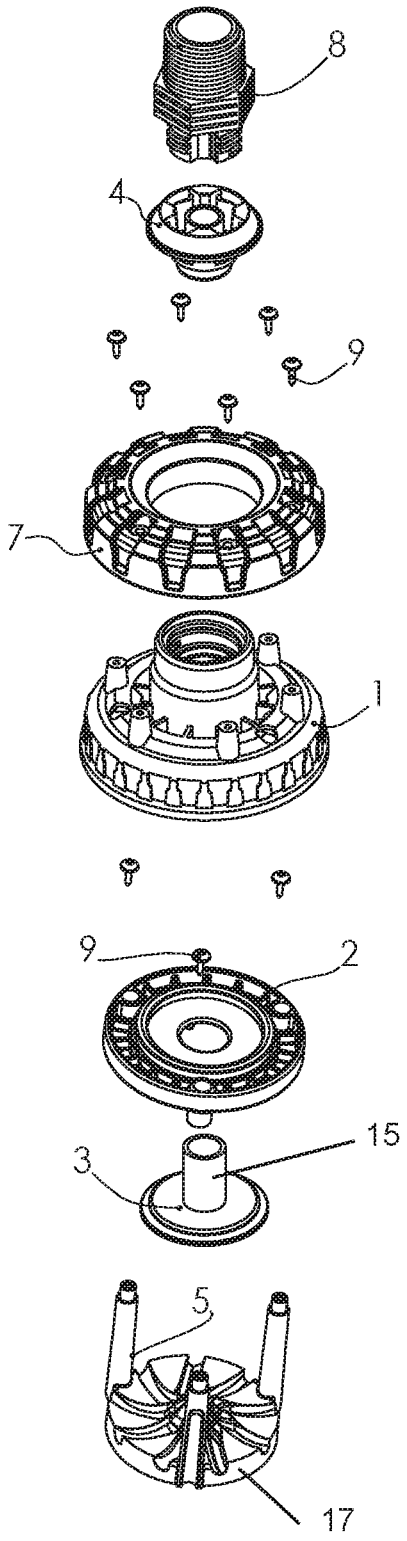
FIG. 3 is an exploded view of a first embodiment of a sprinkler head.

A first embodiment of the disclosed technology is shown FIGS. 1, 2, and 3. FIG. 1 shows the disclosed sprinkler head in what is called a vertical orientation. The sprinkler head can operate in an inverted orientation, but the orientation shown in the figures will be termed vertical, as regards parts with a "top" side or a "bottom" side.

Extending through the sprinkler body is a fluid delivery tube 15. Typically inserted in the fluid delivery tube is a fluid constriction nozzle 4, which is shaped like a funnel to force the fluid into a more narrow stream, for more velocity and force when it hits the strike plate, and for more distance that the fluid is thrown from the sprinkler head.

Shown in FIG. 1 is a sprinkler head for an irrigation system. Fluid (or other liquid) enters the irrigation system from an external source via input nozzle 8. Fluid passes from the input nozzle through a constricting fluid nozzle 4 located within the sprinkler head and out of the sprinkler body through a fluid delivery tube 15. In a preferred embodiment the fluid input nozzle can be removed to allow for replacement of the fluid restricting nozzle. The fluid dispelled from the fluid delivery tube strikes a strike plate of a fluid distribution cage 5, which has an upper cage plate 2 (also called a swash plate or ring) and a lower cage plate 17 (also called a strike plate). Each of the cage plates has an upper or first surface and a lower or second surface. The upper and lower cage plates are connected to each other and held in a spaced apart relationship by one or more cage arms.

Fluid sprayed from the constricting nozzle through the fluid delivery tube hits the strike plate at the peak of the strike plate. The peak has a beveled top surface, which is positioned to cause the cage deflect to one side when first struck by a stream of fluid. The bevel is aligned perpendicular to the raised projections on the underside of the swash plate. The strike plate 17 includes a number of spirally radiating grooves that distribute fluid sprayed from the sprinkler body in an irrigation pattern. The strike plate has an upturned edge around the periphery of the plate that further serves to direct fluid being distributed. A stream of fluid sprayed on the peak from the fluid distribution tube causes the cage to begin nutating around the fluid distribution tube. As the fluid stream continues, the cage nutates around the fluid distribution tube altering the angle and location on the cage that the fluid stream hits, thus continuously altering the fluid pattern distributed from the sprinkler head.

FIG. 2 shows a cross sectional view of the sprinkler head of FIG. 1. The sprinkler body includes a lower sprinkler body plate 3, and an upper sprinkler body plate 1. These plates are on either side of the upper cage plate 2. The upper cage plate 2 has at least one raised projection 14 which destabilizes the cage plate 28 and helps initiate the nutating motion of the cage when fluid is flowing through the sprinkler head. Also visible in FIG. 2 is a first resilient cushion 11 and a second resilient cushion 10. The first resilient cushion 11 and the second resilient cushion 10 form the lip of the upper cage plate in this particular embodiment, and contact the race 13 in the lower sprinkler body plate and the race 12 in the upper sprinkler body plate 1. The races can be grooves, indentations, or notches in the upper and lower sprinkler body plate configured to accept the resilient cushion of the upper cage plate during the nutation process.

A weight 7 is shown in the depicted embodiments. The optional weight is utilized to dampen the vibrations caused by the nutation and help prevent wind from blowing the sprinklers away from vertical when they are hung over the crop on hose. Alternatively the weight can be integral with the sprinkler body.

FIG. 3 illustrates an exploded view of the sprinkler head shown in FIGS. 1 and 2. The fluid delivery tube can be provided as shown to be a unitary piece with the lower sprinkler body plate. The fluid delivery tube and plate can be manufactured as a single piece or alternatively welded, glued or otherwise connected to provide a single piece. Similarly the fluid delivery tube can be integral with the upper sprinkler body plate. Alternatively the fluid deliver tube can be provided as a separate piece from the upper sprinkler body plate and the lower sprinkler body plate as shown in the embodiment depicted in FIGS. 4, 5, and 6.

Figure 4:
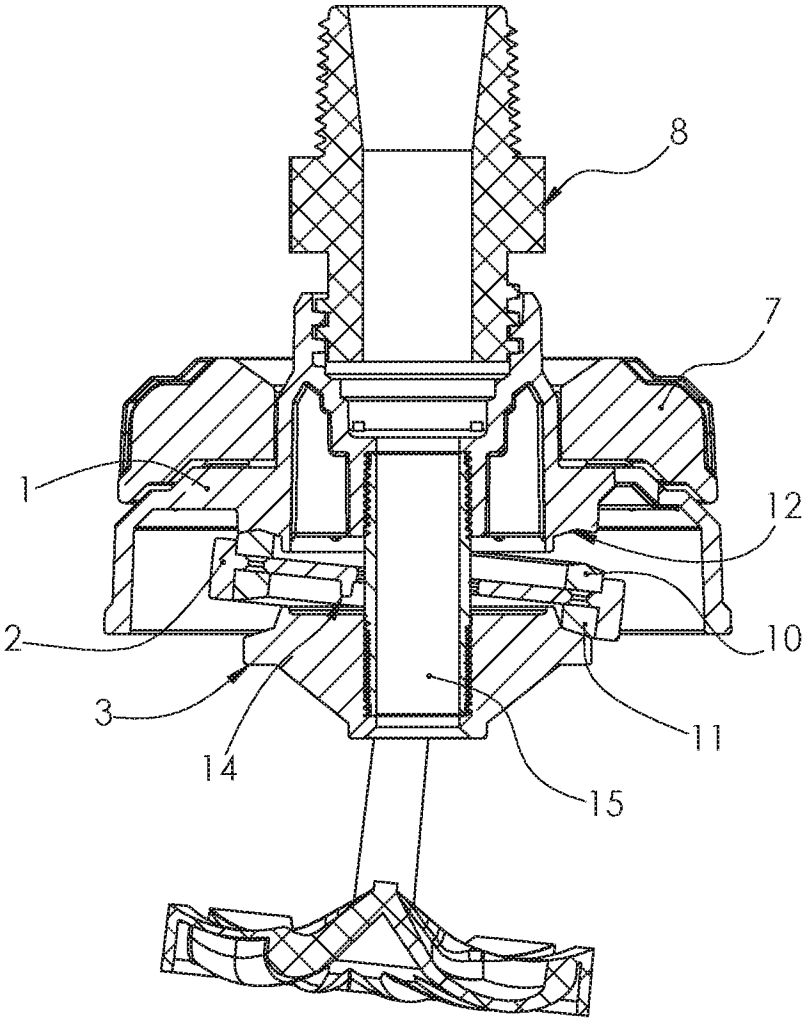
FIG. 4 is a cross sectional view of a second embodiment of a sprinkler head through the center of the sprinkler head.
Figure 5:
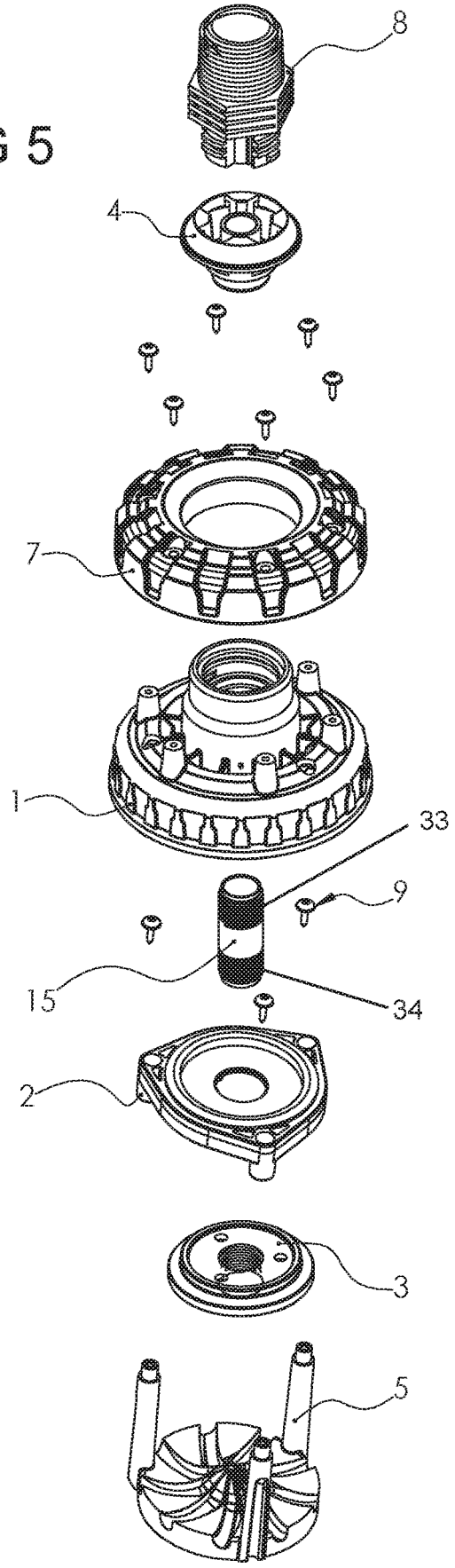
FIG. 5 is an exploded view of a second embodiment of a sprinkler head.
Figure 6:
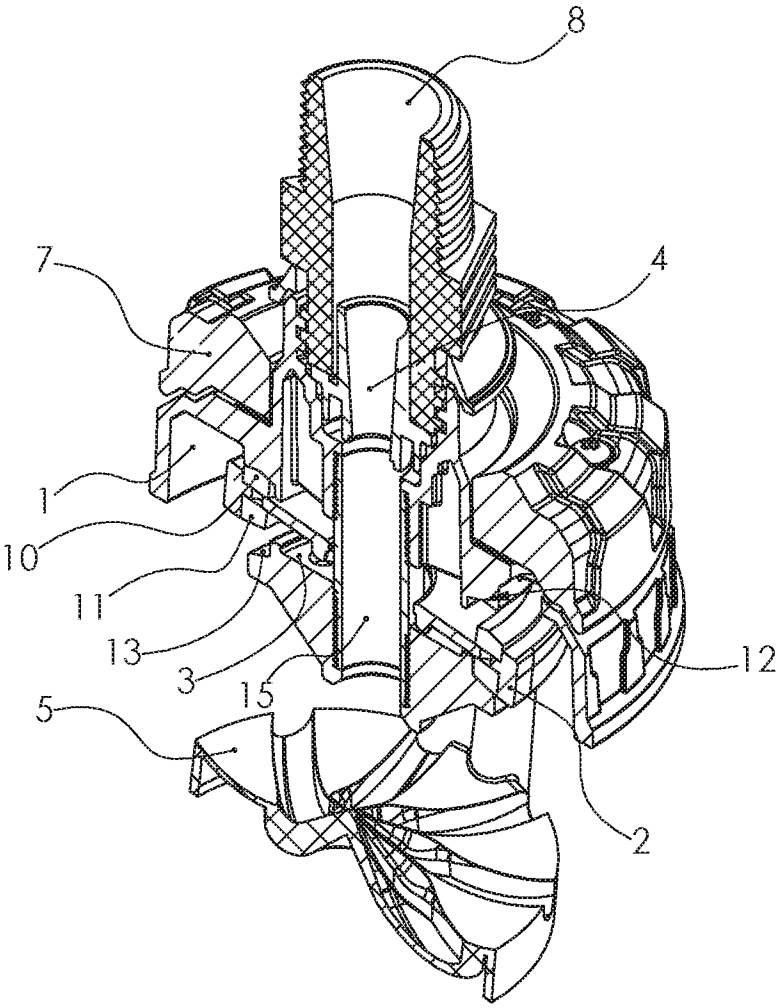
FIG. 6 is a perspective cross sectional view of a second embodiment of a sprinkler head.
Figure 7:
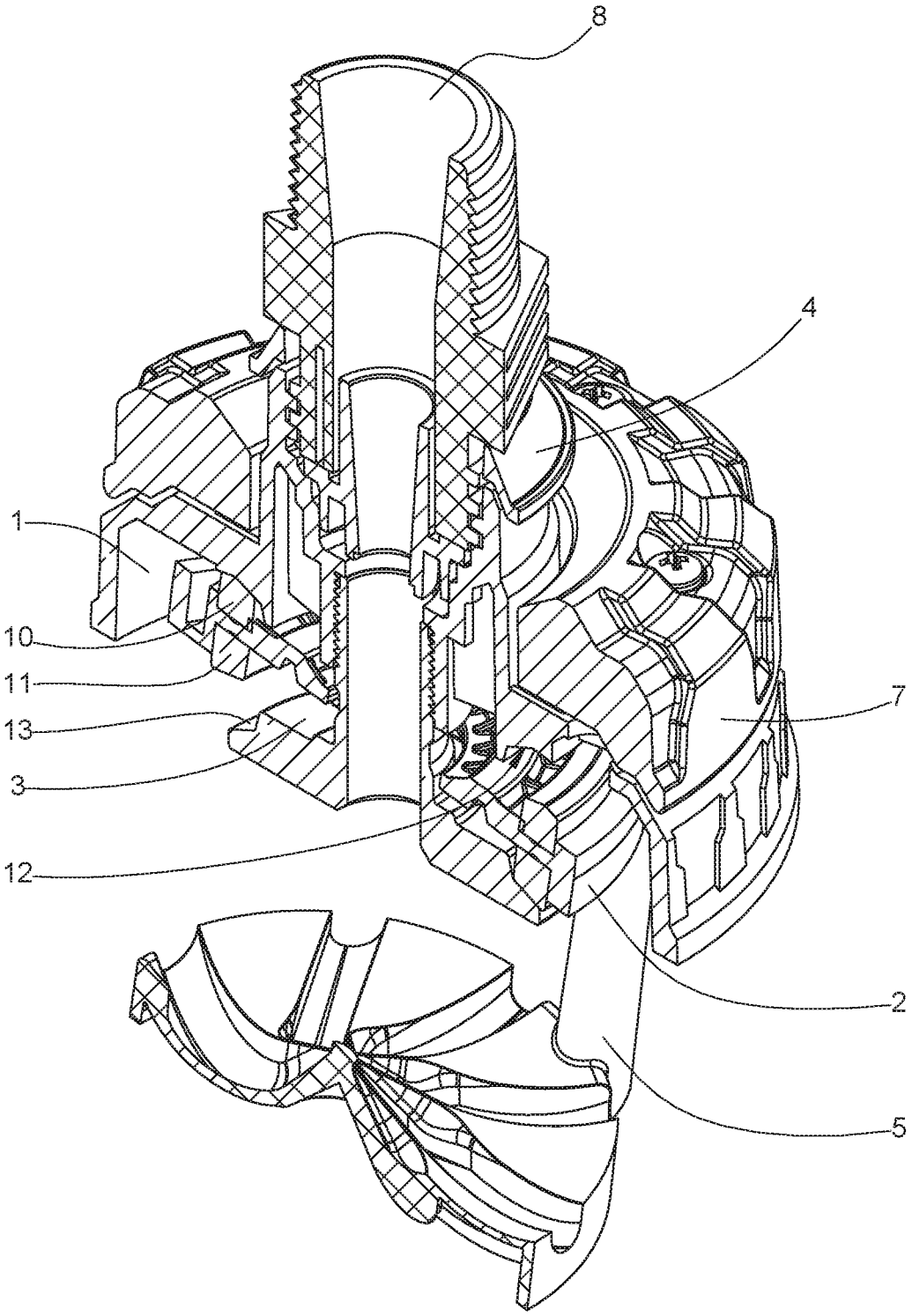
FIG. 7 is a perspective cross sectional view of a third embodiment of a sprinkler head.
Figure 8:
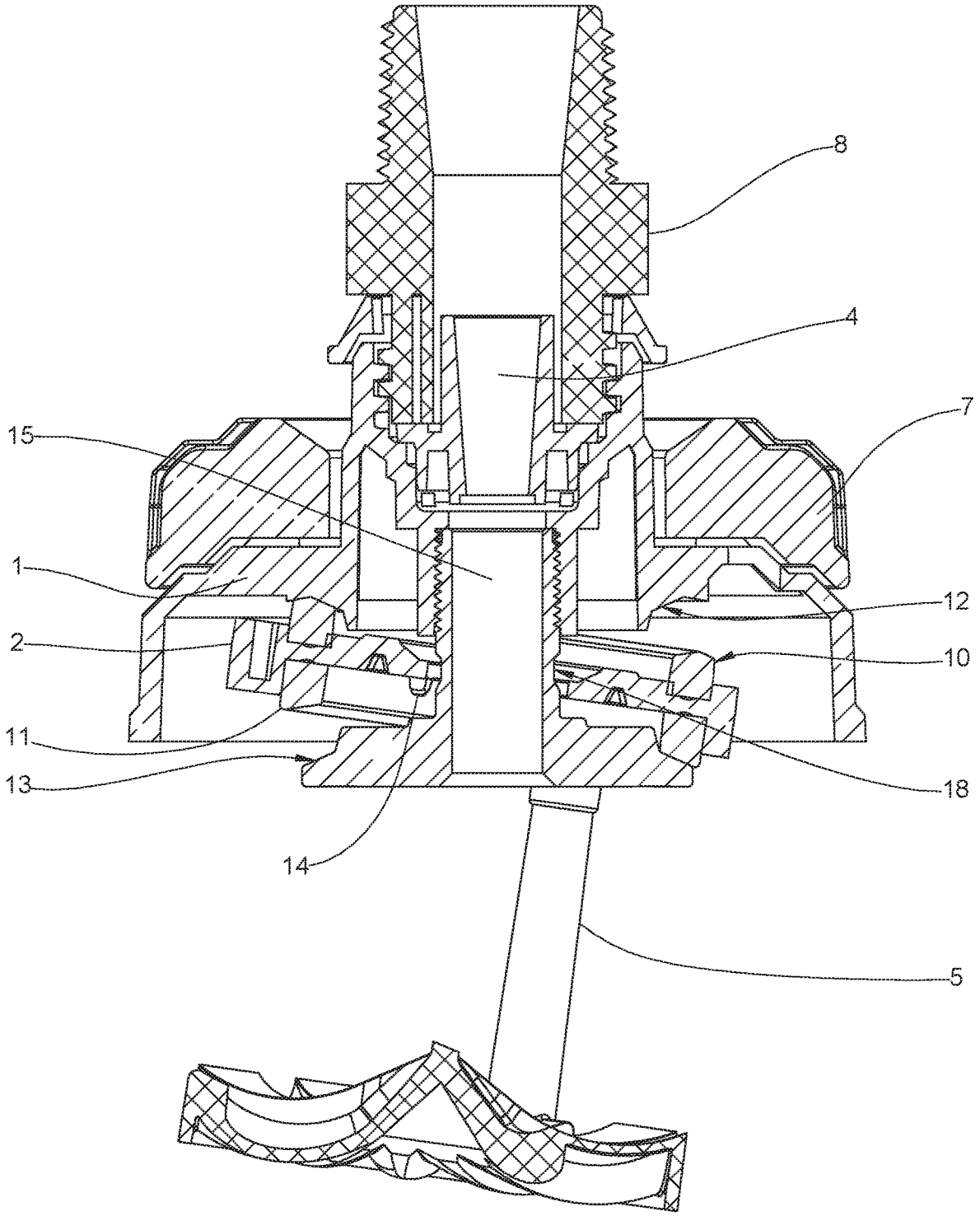
FIG. 8 is a cross sectional view of a third embodiment of a sprinkler head.
Figure 9:
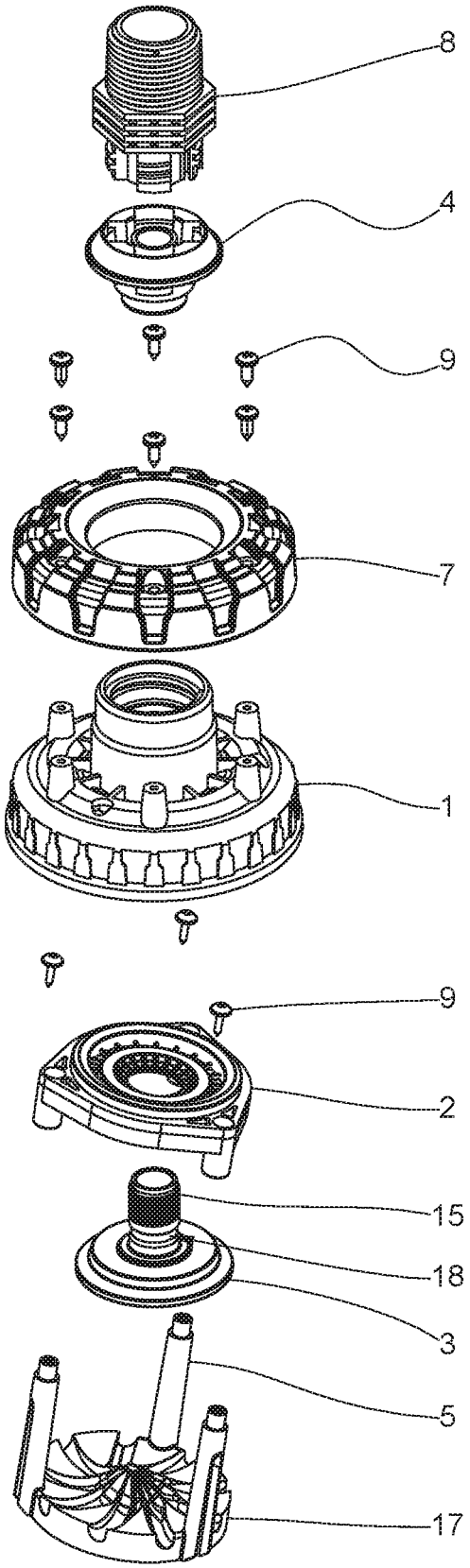
FIG. 9 is an exploded view of a first embodiment of a sprinkler head.
Figure 10:
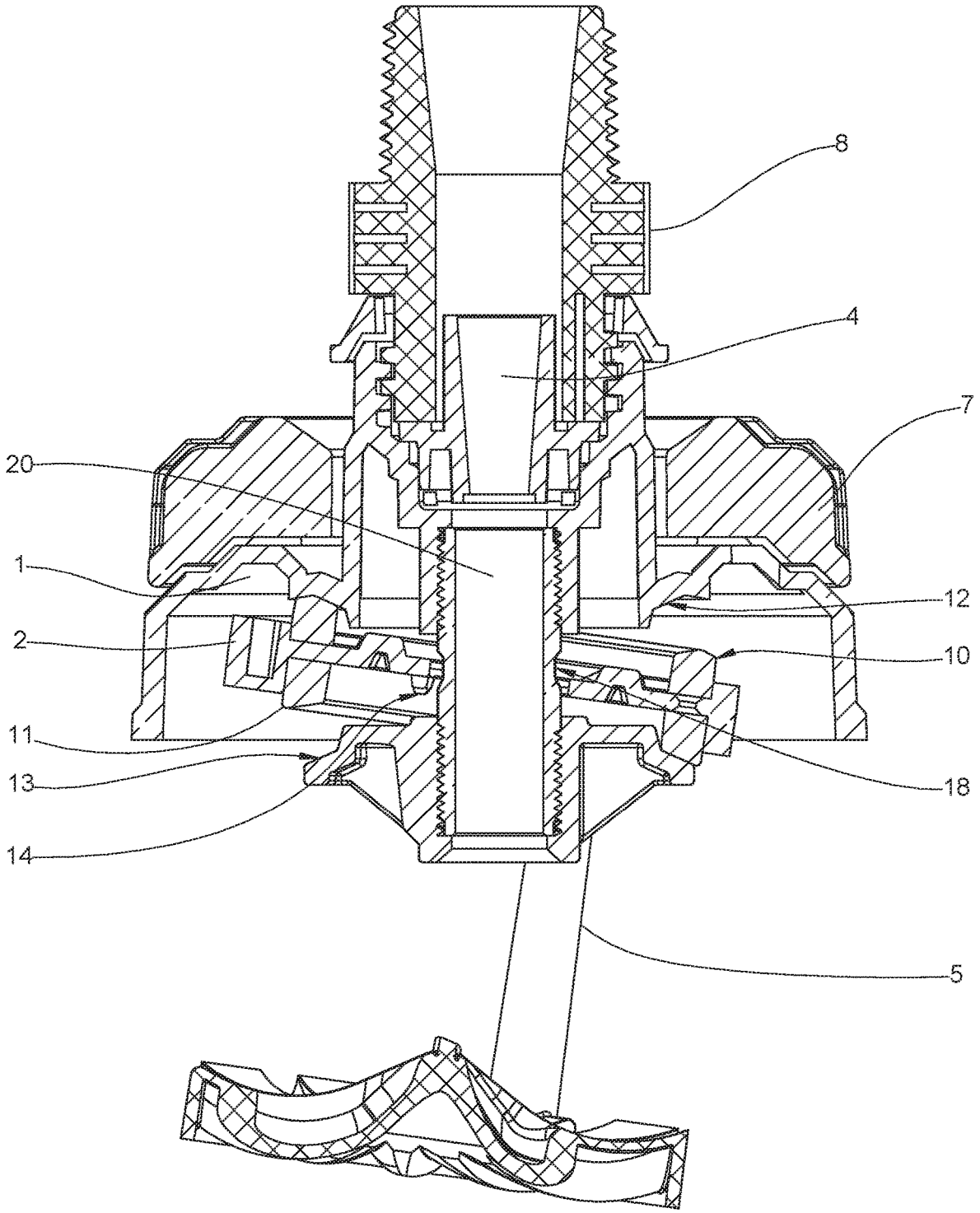
FIG. 10 is a cross sectional view of a fourth embodiment of a sprinkler head through the center of the sprinkler head.
Figure 11:
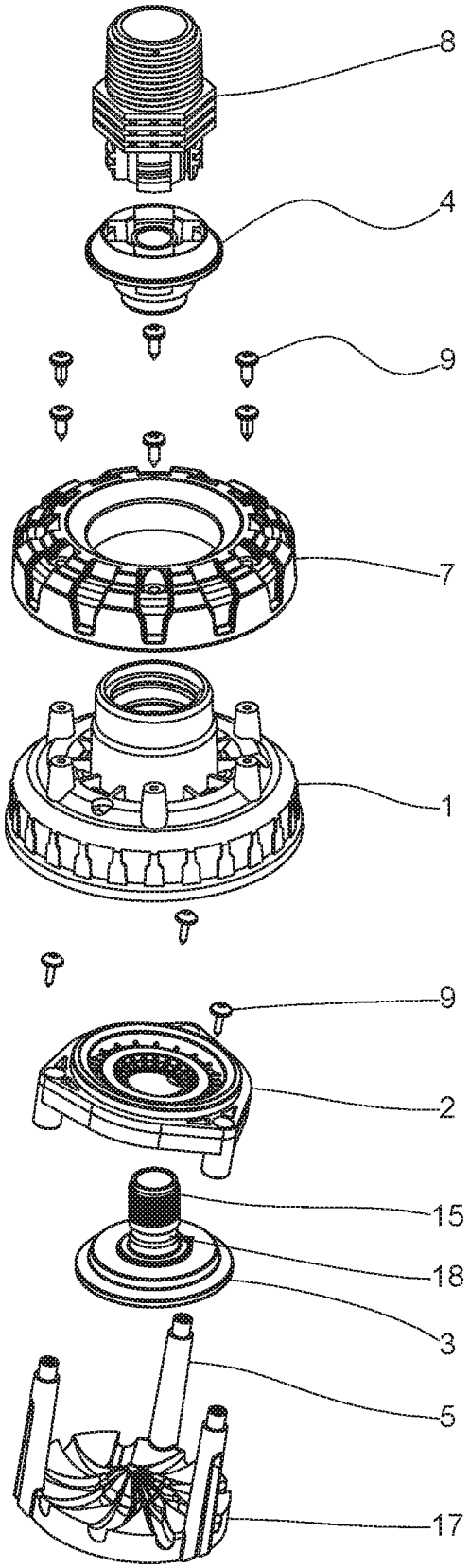
FIG. 11 is an exploded view of a second embodiment of a sprinkler head.
Figure 12:
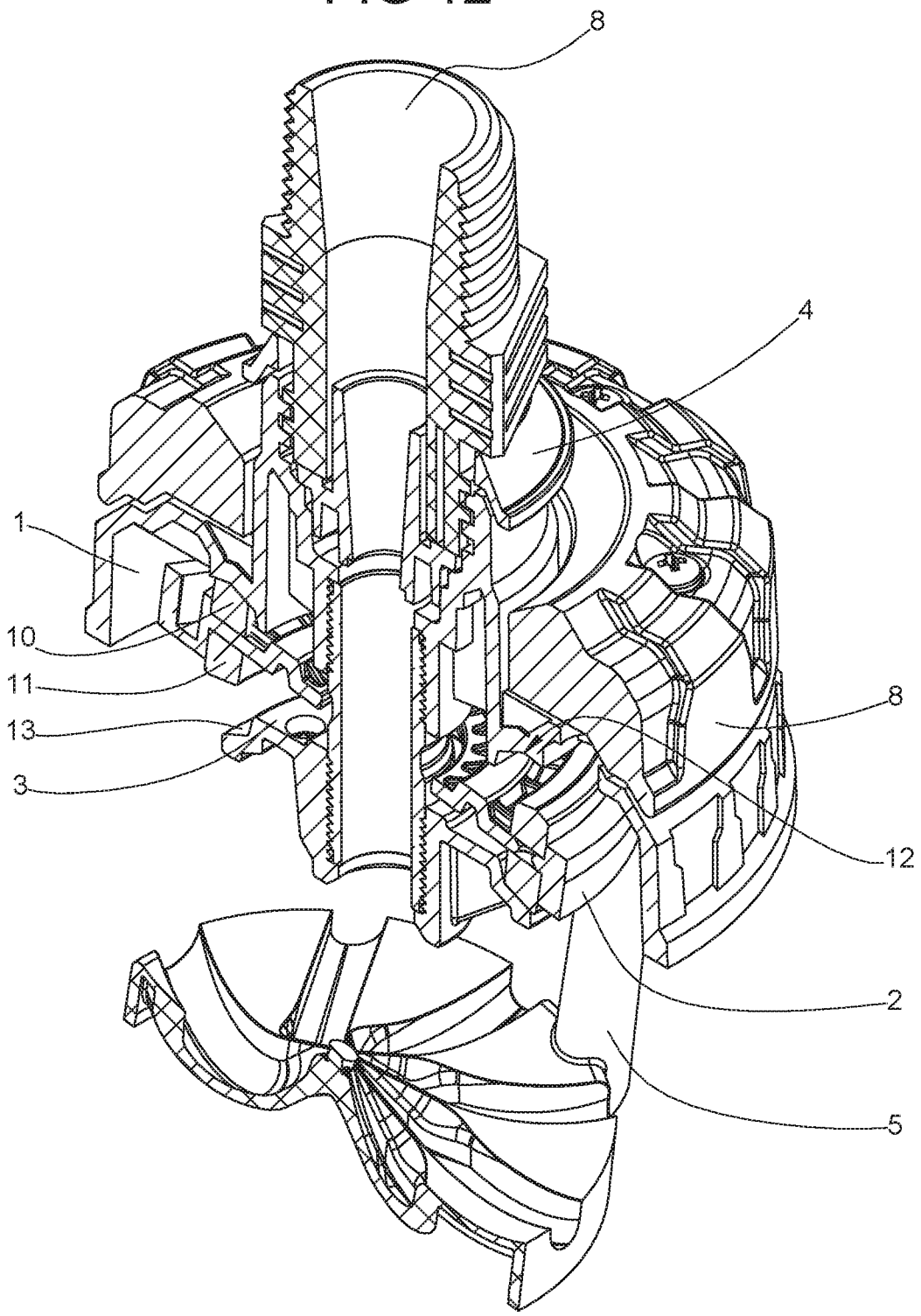
FIG. 12 is a perspective cross sectional view of an embodiment of a sprinkler head.

FIGS. 4, 5, and 6 illustrate an embodiment of the invention in which the fluid delivery tube is threaded at both ends to provide for threaded engagement with the upper sprinkler body plate and the lower sprinkler body plate. In this embodiment the fluid delivery tube is a metal tube, although other acceptable materials can be used. FIG. 5 depicts a trilobal swash plate 2 connected by three legs to the to lower sprinkler cage plate.

FIGS. 7 through 12 illustrate embodiments of the invention including a notch 18 in the circumference of the fluid delivery tube. The notch provides a relief for the swash ring on the fluid delivery tube. The notch facilitates the initiation of nutation when fluid is sprayed from the nozzle through the fluid delivery tube and onto the fluid distribution plate (or lower cage plate). Further in a preferred embodiment the escapement 19 of the upper race is provided at an angle to further facilitate initiation of nutation of the fluid distribution cage. The relief, preferably in combination with the angled escapement of the upper race aide in avoiding stalling of the fluid distribution cage by contacting the fluid delivery tube when fluid is first sprayed from the nozzle onto the lower fluid distribution cage.

Figure 13:
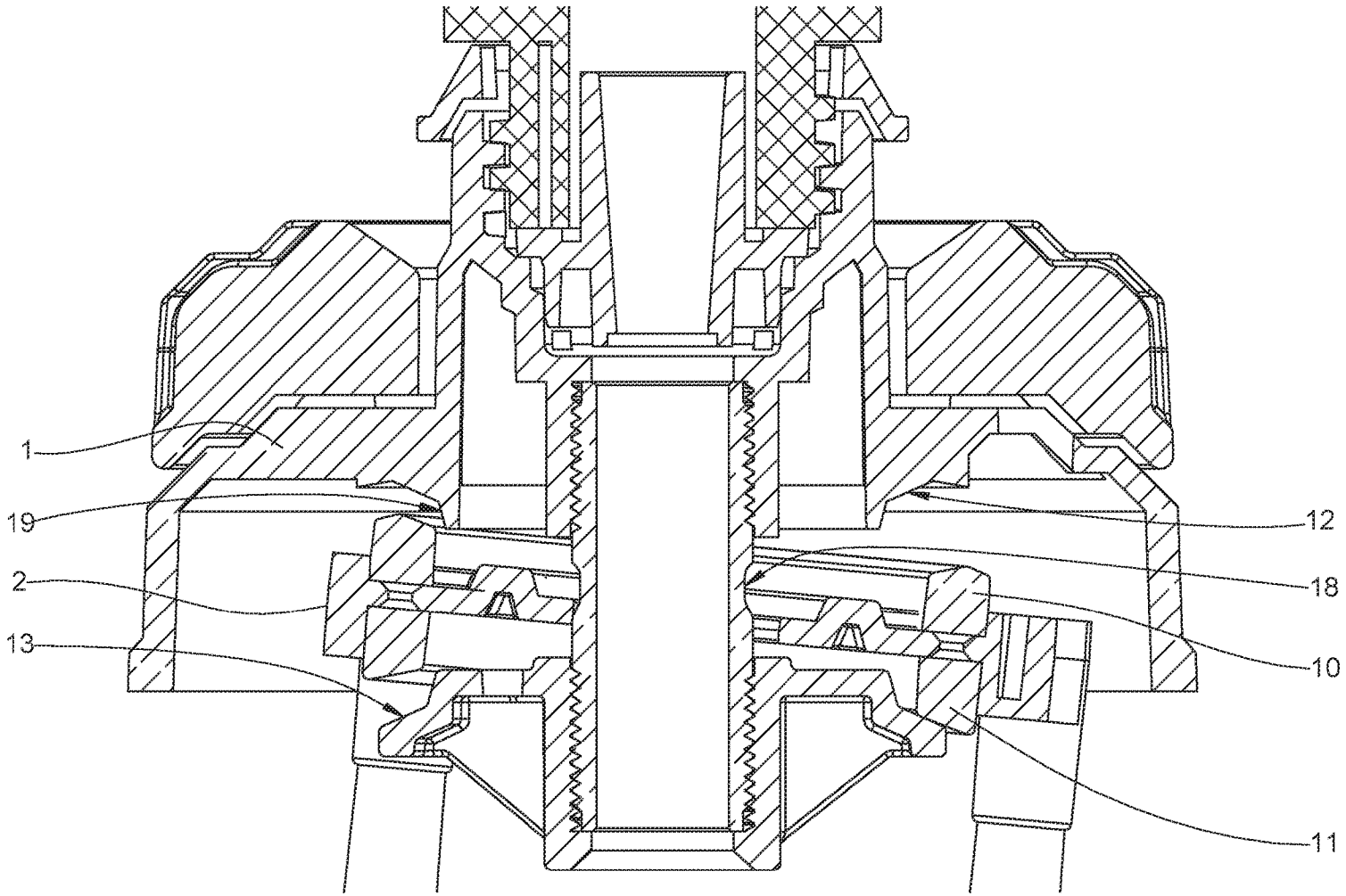
FIG. 13 is a cross sectional view of an embodiment of a sprinkler head with a fluid distribution cage at rest on a pair of starting projections.
Figure 14:
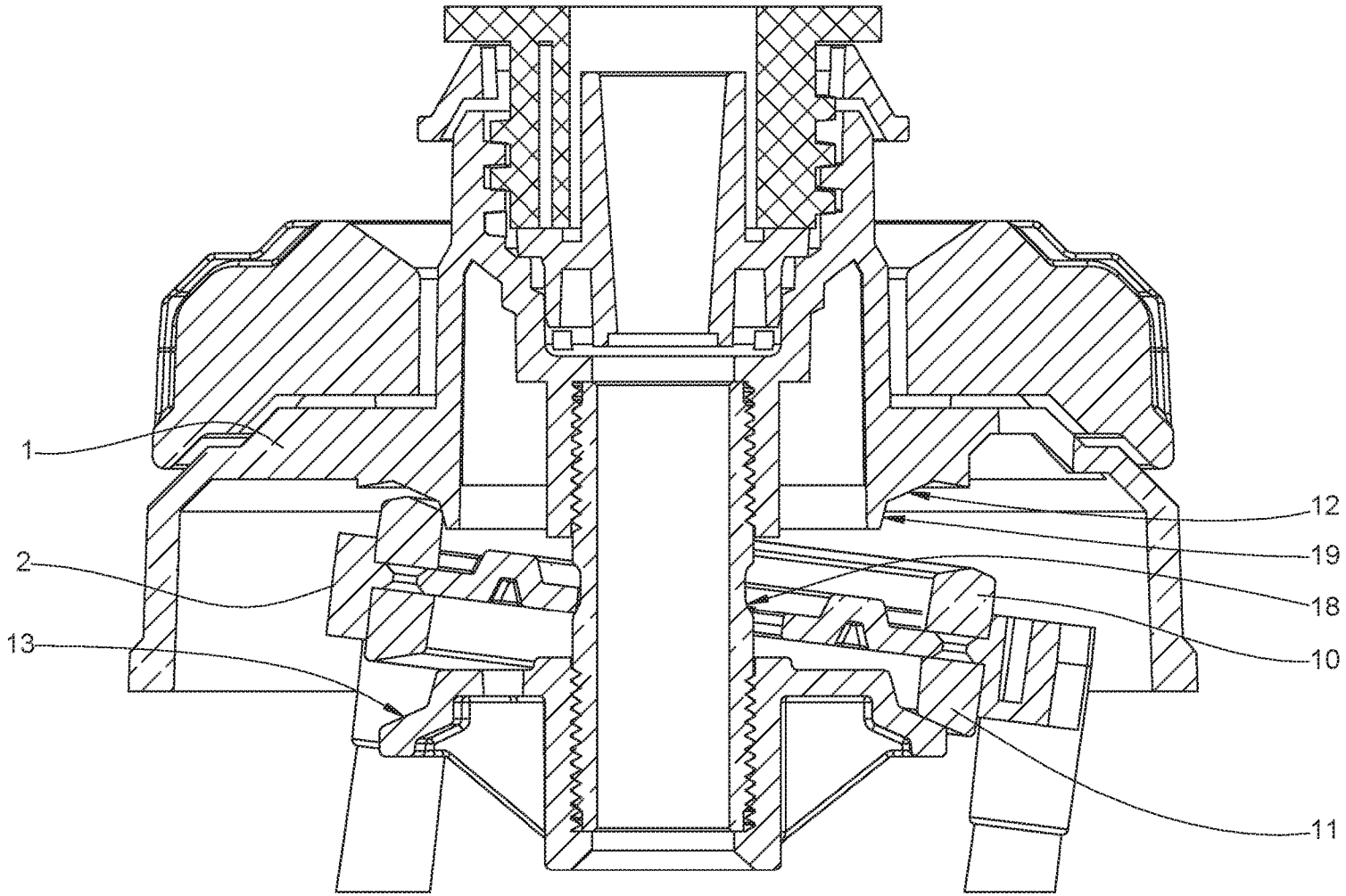
FIG. 14 is a cross sectional view of an embodiment of a sprinkler head with a fluid distribution cage initiating nutation.
Figure 15:
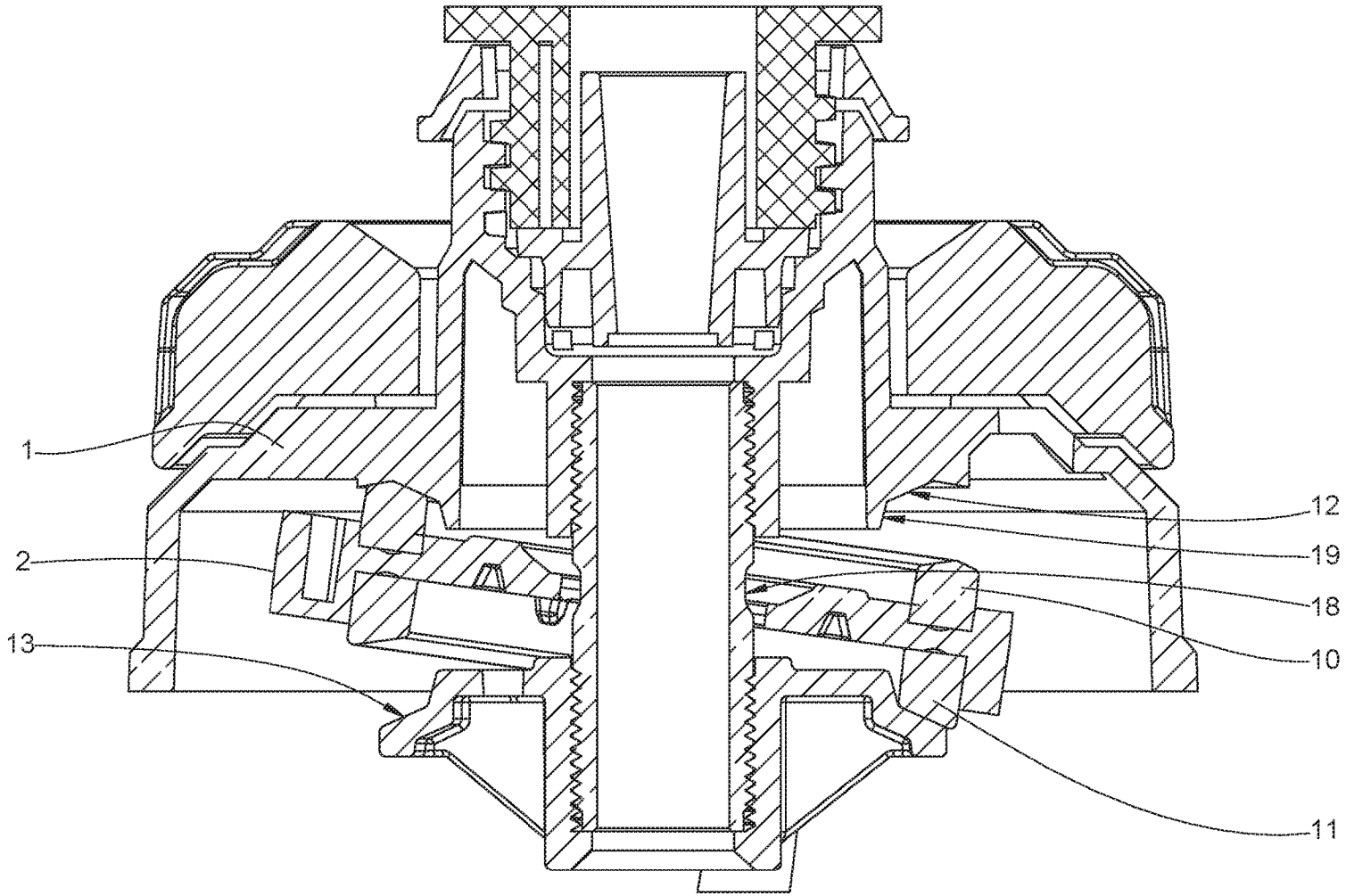
FIG. 15 is a cross sectional view of an embodiment of a sprinkler head proceeding toward nutation.
Figure 16:
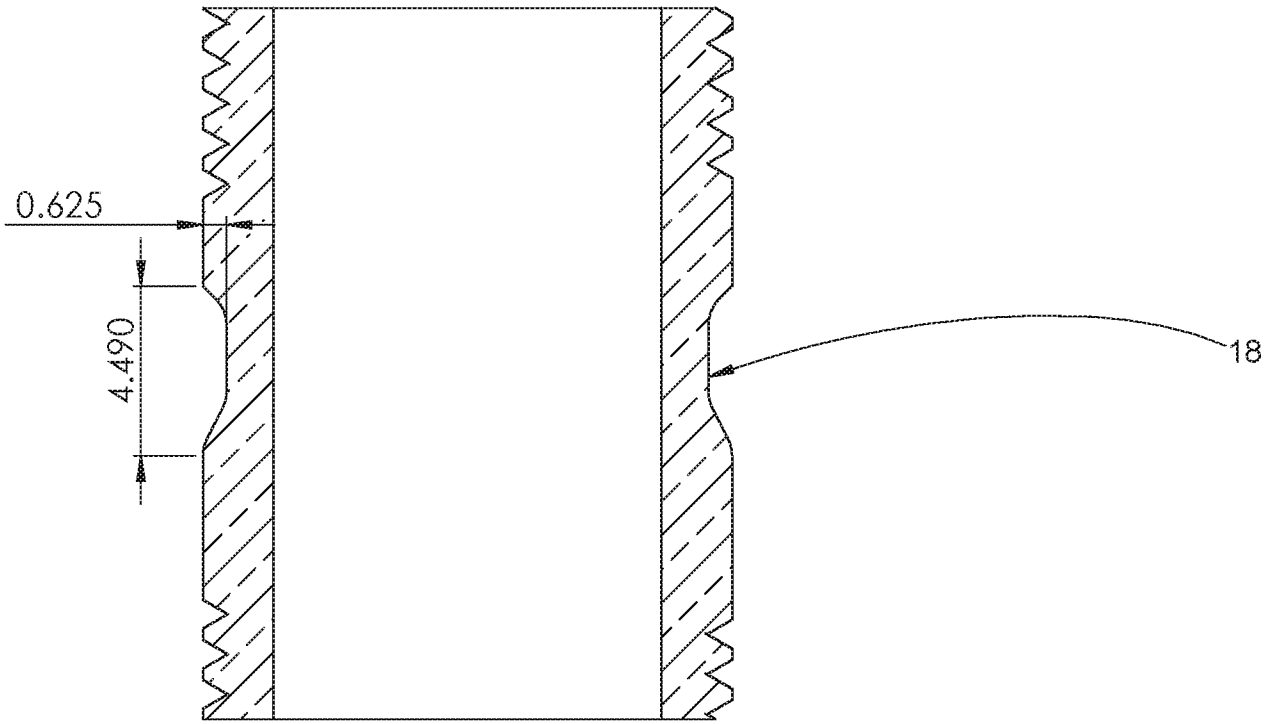
FIG. 16 is a cross sectional view of the fluid delivery tube of the sprinkler head shown in FIG. 15.

FIGS. 13 through 15 illustrate the progression of nutation of the fluid distribution cage when a relief in the fluid distribution tube is utilized as well as an angled race escapement FIG. 13 illustrates the fluid distribution cage at rest on the starting bumps. FIG. 14 illustrates a side of the fluid distribution cage rotating upward due to fluid striking the distribution plate. The upper cushion of the upper cage plate hits the escapement, with the angle of the escapement allowing the cushion to slide into up into the upper race. The inner edge of the upper cage plate proceeds into the relief in the circumference of the fluid delivery tube and prevents the inner edge of the upper distribution cage from rubbing on the circumference of the fluid delivery tube. FIG. 15 illustrates the upper cage plate in nutating position following initiation. The cushions of the swash plate have fully entered the races and nutation is proceeding. FIG. 16 shows a cross sectional view of the fluid delivery tube of FIG. 15 to provide an illustration and representative dimensions of the notch 18 in the fluid delivery tube.

While certain exemplary embodiments are shown in the Figures and described in this disclosure, it is to be distinctly understood that the presently disclosed inventive concept(s) is not limited thereto but may be variously embodied to practice within the scope of this disclosure. From the foregoing description, it will be apparent that various changes may be made without departing from the spirit and scope of the disclosure as defined herein.

What is claimed is:

1. A fluid distributing sprinkler head, comprising, a fluid delivery tube (218) with an attached fluid nozzle;

a sprinkler body partially enclosing said fluid delivery tube and nozzle;

a sprinkler body upper plate attached to an upper end of said fluid delivery tube;

a sprinkler body lower plate attached to a lower end of said fluid delivery tube;

a fluid distribution cage freely attached to said fluid delivery tube lower end, said fluid distribution cage with a lower cage plate with a first and second side, and an upper cage plate with a first and second side, with said cage plates held in a spaced apart relationship by one or more cage arms;

wherein said upper cage plate defining a passage for said fluid delivery tube lower end, and also having at least one raised projection adjacent to said passage for said fluid directing tube, said upper cage plate comprising a first resilient cushion and a second resilient cushion;

said lower cage plate first side having a generally peaked surface, said peaked surface incised by spirally radiating grooves with a peak on said lower plate first side centrally positioned and having a beveled top surface;

wherein said fluid distribution cage is configured to hang freely from said at least one raised projection when said cage is without fluid and said sprinkler head is in a vertical position, with said bevel on said lower plate configured for deflection by an initial jet of fluid from said fluid directing tube, to initiate a nutating motion in said cage after said initial deflection with said nutating motion maintained by a force of fluid on said spirally radiating grooves causing said upper cage plate to nutate between said sprinkler body upper plate and said sprinkler body lower plate, wherein said first resilient cushion is configured to contact said sprinkler body upper plate at a sprinkler body upper plate race and said second resilient cushion is configured to contact said sprinkler body lower plate at a sprinkler body lower cage plate race when said upper cage plate is nutating between said sprinkler body upper plate and said sprinkler body lower plate.

2. The sprinkler head of claim 1, wherein said at least one raised projection comprises a pair of raised projections adjacent said passage for said fluid delivery tube, with said pair of raised projections positioned opposite each other on a second side of said upper cage plate.

3. The sprinkler head of claim 1, wherein said sprinkler body upper plate is configured for threaded attachment to the upper end of said fluid delivery tube, wherein said sprinkler body lower plate is configured for threaded attachment to the lower end of said fluid delivery tube.

4. The sprinkler head of claim 1, wherein said first resilient cushion is attached to the first side of said upper cage plate and said second resilient cushion is attached to the second side of said upper cage plate.

5. The sprinkler head of claim 1, wherein said fluid delivery tube comprises a groove in an outer circumference of an outer surface of said fluid delivery tube configured to provide relief from contacting said upper cage plate at said outer surface of said fluid delivery tube upon initiation of nutation of said fluid distribution cage.

* * * * *